US009700143B2

(12) United States Patent
Wu

(10) Patent No.: US 9,700,143 B2
(45) Date of Patent: Jul. 11, 2017

(54) ADJUSTABLE LUMBAR SUPPORT APPARATUS FOR SEAT BACK

(71) Applicant: Yao-Chuan Wu, Chiayi Hsien (TW)

(72) Inventor: Yao-Chuan Wu, Chiayi Hsien (TW)

( * ) Notice: Subject to any disclaimer, the term of this patent is extended or adjusted under 35 U.S.C. 154(b) by 106 days.

(21) Appl. No.: 14/754,225

(22) Filed: Jun. 29, 2015

(65) Prior Publication Data

US 2016/0374474 A1 Dec. 29, 2016

(51) Int. Cl.
*A47C 7/46* (2006.01)

(52) U.S. Cl.
CPC ..... *A47C 7/462* (2013.01)

(58) Field of Classification Search
CPC ..... A47C 7/462
USPC ..... 297/284.4, 284.8; 248/178.1
See application file for complete search history.

(56) References Cited

U.S. PATENT DOCUMENTS 3,464,754 A * 9/1969 Berger ..... A47C 7/462 297/284.8
3,596,990 A * 8/1971 Gottfried ..... A47C 7/462 297/284.8
4,097,087 A * 6/1978 Garavaglia ..... A47C 7/46 297/230.14
4,406,496 A * 9/1983 Drabert ..... A47C 7/462 297/284.1
4,576,410 A * 3/1986 Hattori ..... A47C 7/462 297/284.4
4,811,986 A * 3/1989 Hattori ..... A47C 7/462 297/284.1
4,886,316 A * 12/1989 Suzuyama ..... B60N 2/667 297/284.4
4,893,872 A * 1/1990 Sugai ..... A47C 7/462 297/284.8
4,925,242 A * 5/1990 Harris ..... A61G 5/10 280/250.1
5,215,350 A * 6/1993 Kato ..... B60N 2/66 297/284.1
5,224,757 A * 7/1993 Geitz ..... A47C 7/462 297/284.2
5,567,010 A * 10/1996 Sparks ..... B60N 2/667 297/284.1

(Continued)

FOREIGN PATENT DOCUMENTS

KR WO 2013089308 A1 * 6/2013 ..... A47C 7/462

*Primary Examiner* — David R Dunn
*Assistant Examiner* — Tania Abraham
(74) *Attorney, Agent, or Firm* — patenttm.us

(57) ABSTRACT

An adjustable lumbar support apparatus for a seat back is disclosed and includes a lumbar support and two adjusting assemblies respectively disposed at two sides of the seat back. Each of the adjusting assemblies includes a supporting sheet disposed on an exterior surface of the seat back, an acting rod disposed in a positioning cylinder base on a front end of the seat back, and a knob disposed on a rear end of the seat back. The acting rod and the knob are co-acting, and the acting rod and the supporting sheet are corresponding to each other by the slope surface and the acting slope surface. When the knob is rotated, the corresponding relationship between the acting slope surface and the slope surface is varied. The distance between the lumbar support and the seat back can be adjusted in accordance with different requirements under different circumstances to overcome the elastic fatigue problem.

15 Claims, 8 Drawing Sheets

(56) References Cited

U.S. PATENT DOCUMENTS

| | | | | | |
|---|---|---|---|---|---|
| 5,718,476 | A * | 2/1998 | De Pascal | A47C 7/462 | 297/284.1 |
| 5,727,848 | A * | 3/1998 | Gazard | A47C 7/506 | 297/284.8 |
| 6,039,398 | A * | 3/2000 | Gorgi | A47C 1/025 | 297/301.4 |
| 6,095,611 | A * | 8/2000 | Bar | A61G 5/1067 | 297/228.13 |
| 7,303,232 | B1 * | 12/2007 | Chen | A47C 7/38 | 297/284.7 |
| 7,445,287 | B2 * | 11/2008 | Chou | A47C 1/026 | 297/230.14 |
| 7,517,024 | B2 * | 4/2009 | Cvek | A47C 7/282 | 297/218.1 |
| 8,052,213 | B2 * | 11/2011 | Dahlbacka | B60N 2/66 | 297/284.4 |
| 8,573,697 | B1 * | 11/2013 | Su | A47C 7/462 | 297/284.7 |
| 8,845,025 | B2 * | 9/2014 | Kurata | A47C 7/462 | 297/284.1 |

* cited by examiner

ADJUSTABLE LUMBAR SUPPORT APPARATUS FOR SEAT BACK

BACKGROUND OF THE INVENTION

1. Field of the Invention

The present invention relates to an adjustable lumbar support apparatus for a seat back, and more particularly to a lumbar support structure installed in the seat back of a chair.

2. Description of Related Art

For better comfort of sitting, the functions of the chair become more and more diverse. For example, by installing wheels on the chair, the chair is conveniently movable. By adjusting the height of the chair, the chair is suitable for people with different sizes or for different usage circumstances. By adjusting the slope angle of the seat back, a user's back can be supported appropriately. Accordingly, a consumer can choose to purchase the suitable chair in accordance with personal preference.

In order to support the waist when a person is sitting on the chair, the manufacturer installs a lumbar support on the seat back of the chair. Since the lumbar support is protruded from the seat back, the waist of the person can be supported to relieve the sore waist condition. Moreover, in order to have a proper elasticity of the lumbar support so as to acquire a better supporting effect, most of the lumbar supports are fixed at two sides and include a hollow part at a middle to provide a suitable cushioning support for the waist.

However, the required waist supporting strength is different for different people and a distance of the lumbar support protruding from the seat back is fixed, so the lumbar support is not suitable for different people with different requirements or one person's requirements under different circumstances. In addition, when a person has been sitting on the chair for a period of time, the lumbar support will be gradually elastic fatigued and the supporting effect of the lumbar support will be decreased.

Accordingly, the conventional lumbar support is fixed on the seat back and the distance between the lumbar support and the seat back cannot be varied. The problems that the conventional lumbar support is not suitable for different people and the distance between the lumbar support and the seat back cannot be adjusted need to be resolved.

SUMMARY OF THE INVENTION

Therefore, in view of the problems of the conventional lumbar support, an adjustable lumbar support for a seat back is developed in the present invention by implementing two adjusting assemblies installed on the seat back and contacted with the lumbar support. A front position and a rear position of the lumbar support can be adjusted by the adjusting assemblies in accordance with the requirement. Accordingly, since the distance between the seat back and the lumbar support is changeable and the protrusive distance of the lumbar support from the seat back is varied, the chair is suitable for different people or a person with different requirements at different time.

Therefore, a main objective of the present invention is to provide an adjustable lumbar support apparatus for a seat back, the adjustable lumbar support apparatus comprising a lumbar support disposed on a front end of the seat back; and two adjusting assemblies disposed between the seat back and the lumbar support, each one of the adjusting assemblies including a supporting sheet connected to a rear end of the lumbar support and including a protruding portion formed on an exterior surface of the supporting sheet and fixed on the seat back; and a positioning cylinder base formed on a rear surface of the supporting sheet, protruding toward the seat back, and including a rear end; a slope surface formed on the rear end of the positioning cylinder base, and a plurality of positioning portions formed on the slope surface of the positioning cylinder base; an acting rod disposed in the positioning cylinder base on a front of the seat back and including: an acting slope surface formed on a front end of the acting rod and facing the positioning cylinder base; a fixing portion formed on a most protruding part of the acting slope surface; and a linkage portion formed on a rear end of the acting rod and protruding toward the seat back; and a knob disposed on a rear end of the seat back, co-acting with the acting rod, and including a protruding rod formed on a front end of the knob, protruding toward the seat back, and passing through the seat back; and an acting portion formed on a front end of the protruding rod and corresponding to the linkage portion of the acting rod.

By implementing the aforementioned adjustable lumbar support apparatus for the seat back, the distance between the lumbar support and the seat back can be adjusted in accordance with the requirements for different people or a person with different requirements under different circumstances, and elastic fatigue caused by the material of the lumbar support can be overcome.

According to the aforementioned adjustable lumbar support apparatus for the seat back, a fastening element is used to fasten the acting rod and the knob, and the linkage portion of the acting rod and the acting portion of the knob are relatively co-acting by the concave groove and the notch in non-circular shape.

By the aforementioned linkage portion and the acting portion co-acting with the non-circular groove and notch, the acting rod can be rotated at the same time when the knob is rotated so as to change the relationship between the acting slope surface of the acting rod and the slope surface of the supporting sheet.

In the aforementioned adjustable lumbar support for the seat back, the positioning portions on the slope surface of the supporting sheet and the fixing portion on the acting slope surface of the acting rod can be protruding blocks and a concave groove respectively or concave grooves and a protruding block respectively.

Since the positioning portions and the fixing portion can be concave grooves and a protruding block respectively or protruding blocks and a concave groove respectively, the distance between the lumbar support and the seat back is fixed after adjustment.

DETAILED DESCRIPTION OF THE PREFERRED EMBODIMENT

The lumbar support apparatus of the present invention includes a lumbar support 10 and two adjusting assemblies 30 respectively disposed at two sides of a seat back 20. The structure showed in FIG. 1-FIG. 3 is one of the adjusting assemblies 30 disposed at one of the sides of the seat back 20 between the lumbar support 10 and the seat back 20 as an example, and the other one of the adjusting assemblies 30 is not showed.

Figure 1:
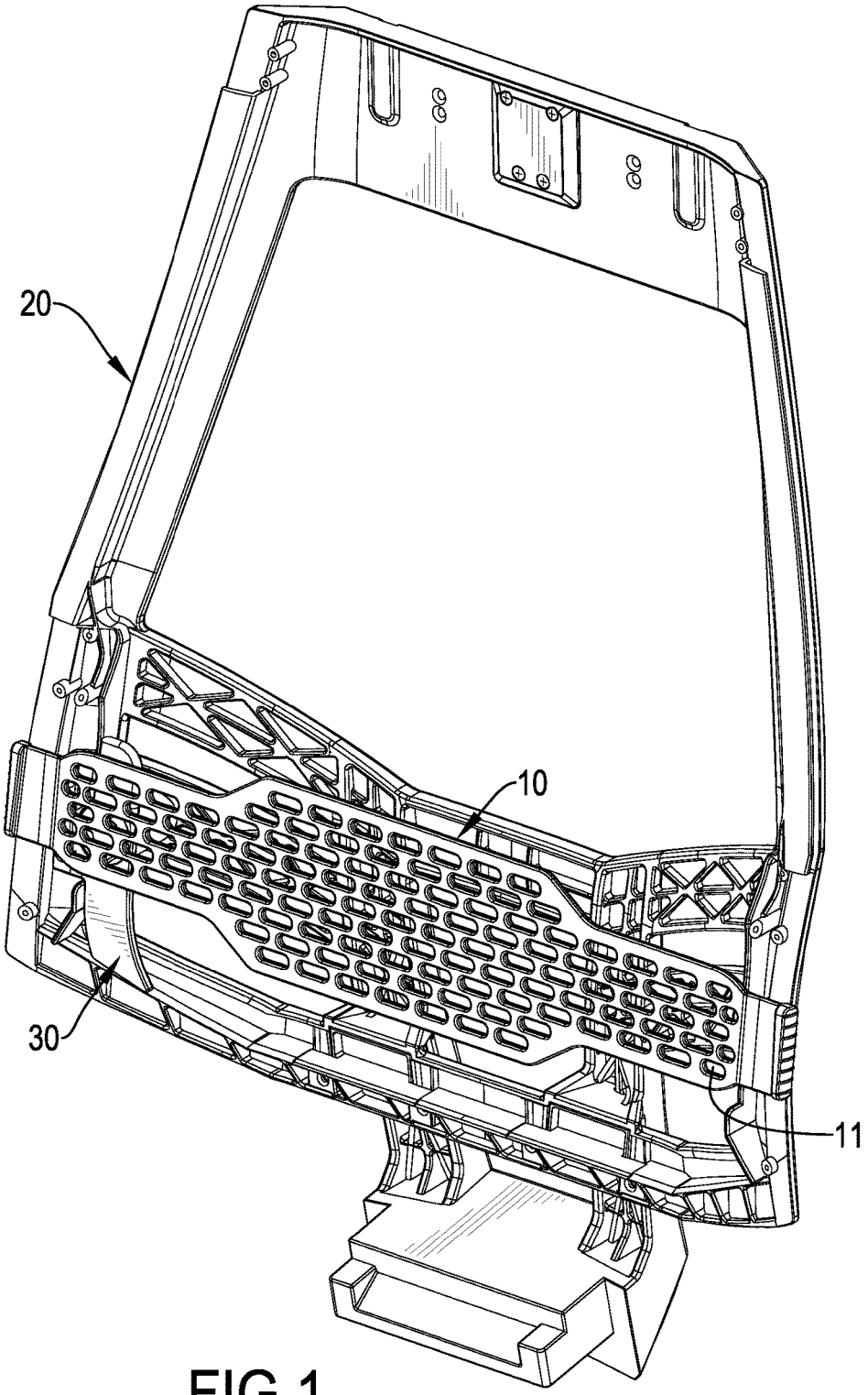
FIG. 1 is a perspective view of an adjustable lumbar support apparatus of the present invention equipped on a seat back with a lumbar support.

With reference to FIG. 1, the lumbar support 10 is made of plastic materials and formed in an elongated shape. A surface of the lumbar support 10 has multiple passing grooves 11 in a mesh-like pattern so as to enhance the ventilation effect. Two sides of the lumbar support 10 can be directly disposed at the specific locations on the seat back 20. Alternatively, hooks at the two sides of the lumbar support 10 are implemented to be locked on the two sides of the seat back 20 to adjust the relative height between the lumbar support 10 and the seat back 20. The lumbar support 10 can satisfy needs of different people or one person under different circumstances.

Figure 2:
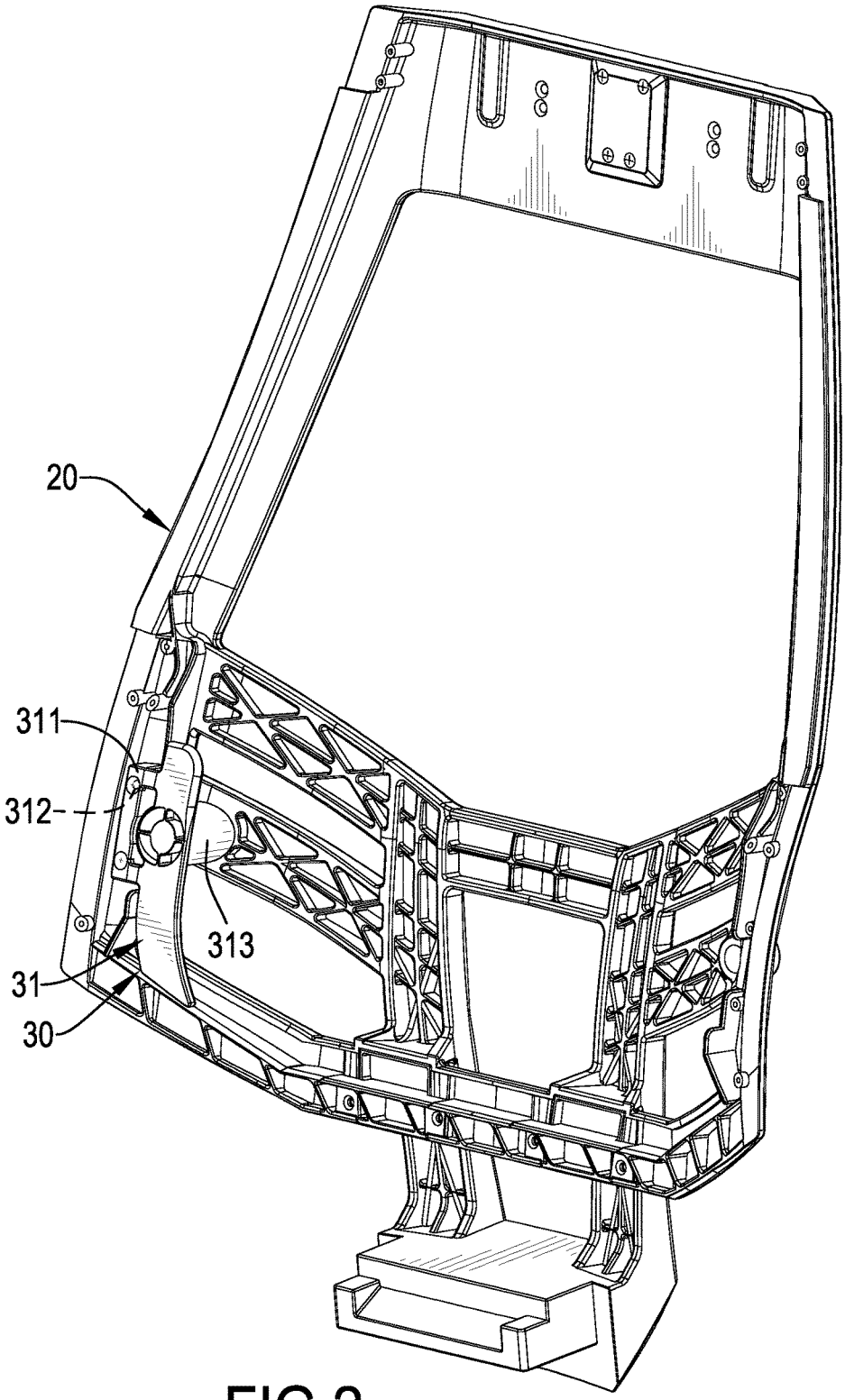
FIG. 2 is a perspective view of the adjustable lumbar support apparatus of the present invention equipped on a seat back.
Figure 3:
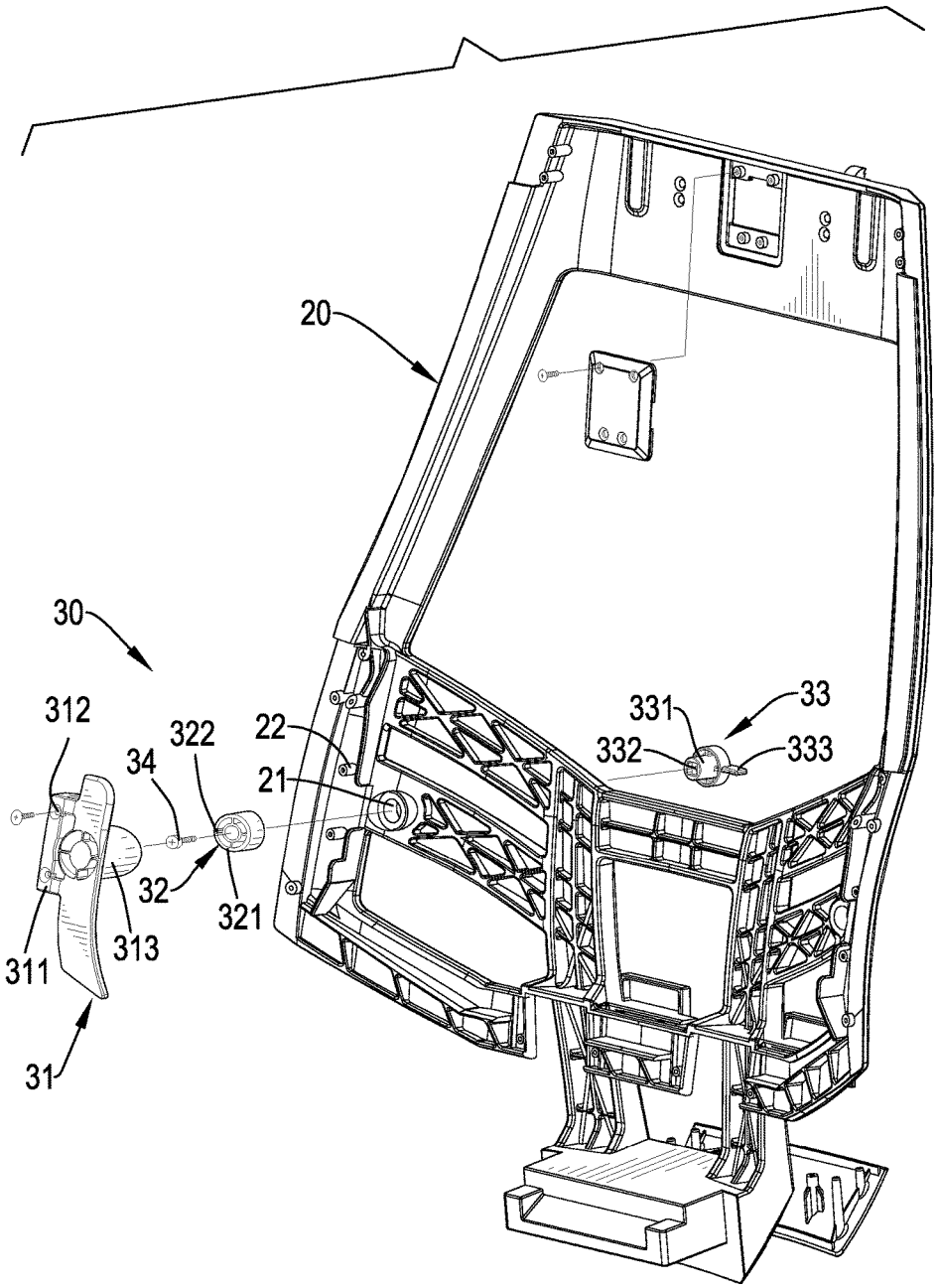
FIG. 3 is an explored perspective view of the adjustable lumbar support apparatus of the present invention equipped on the seat back.

With reference to FIG. 2 and FIG. 3, each one of the adjusting assemblies 30 includes a supporting sheet 31, an acting rod 32 and a knob 33. The supporting sheet 31 includes a protruding portion 311, a positioning cylinder base 313, a slope surface 314 and a plurality of positioning portions 315.

Figure 4:
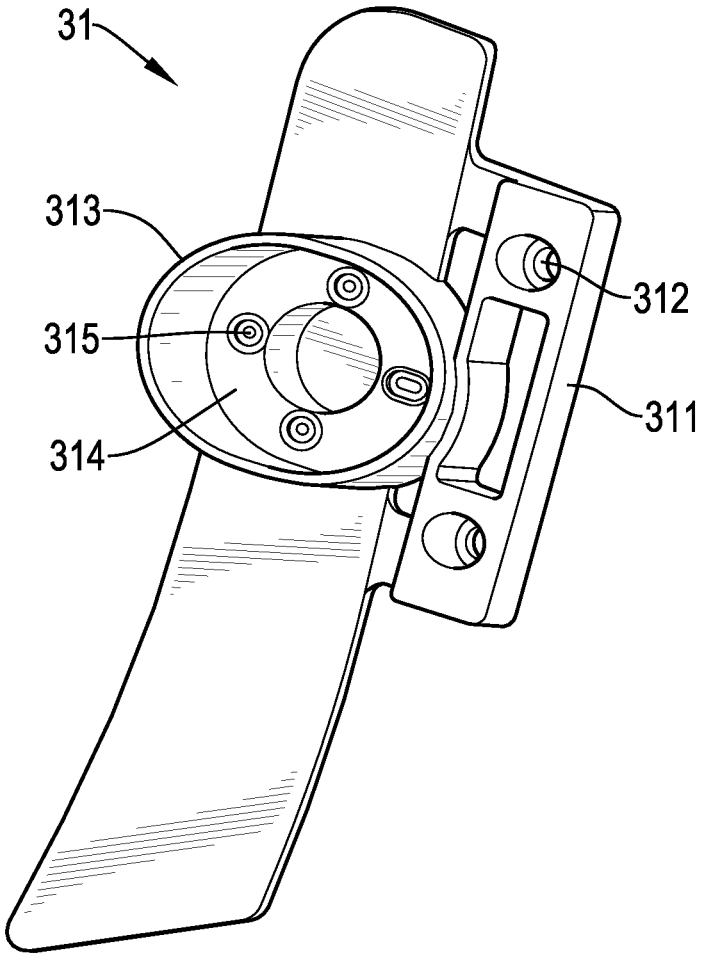
FIG. 4 is a perspective view of a supporting sheet of an adjusting assembly of the adjustable lumbar support apparatus of the present invention.

The protruding portion 311 is formed on an exterior surface of the supporting sheet 31. A through-hole 312 is formed in the protruding portion 311. The supporting sheet 31 is formed in an elongated shape along a longitudinal direction. The positioning cylinder base 313 is formed along the direction from the supporting sheet 31 toward the seat back 20. With reference to FIG. 4, the internal portion of the positioning cylinder base 313 is hollow and the slope surface 314 is formed at a rear end of the positioning cylinder base 313 within the internal portion. The positioning portions 315 are formed on the slope surface 314 and the positioning portions 315 surround the centre of the positioning cylinder base 313 in a circle. The angle between the slope surface 314 and the horizontal axis is preferred to be 60° to 80°. The positioning portions 315 on the slope surface 314 are evenly and circularly disposed at equal angles. Alternatively, the positioning portions 315 are disposed at unequal angles. The number of the positioning portions 315 can be 2 to 8 and the number of the positioning portions 315 shown in the figures is 4.

Figure 5:
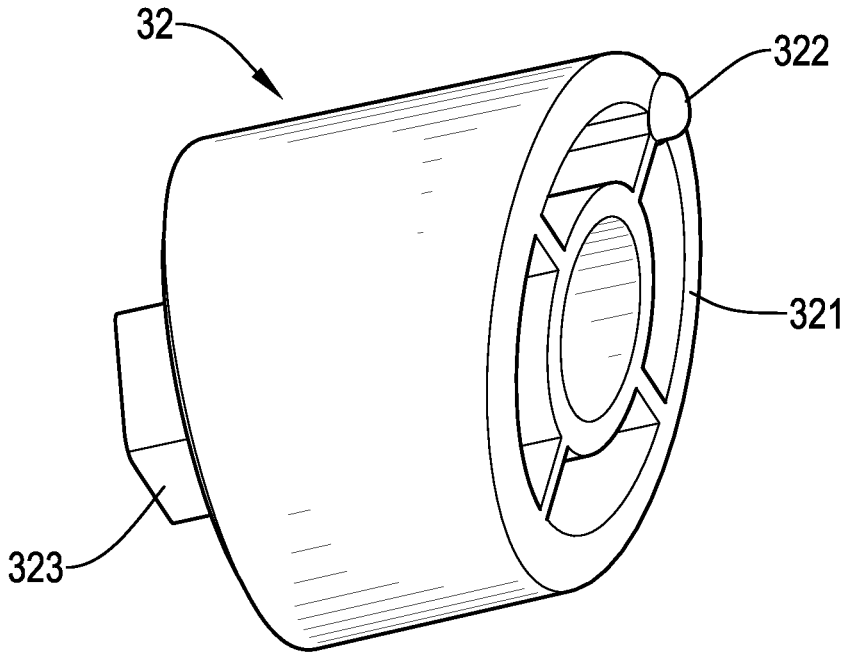
FIG. 5 is a perspective view of an acting rod of the adjusting assembly in the present invention.

With reference to FIG. 3 and FIG. 5, the acting rod 32 is shaped into a round-pole and a diameter of the acting rod 32 is equal to an inner diameter of the positioning cylinder base 313 of the supporting sheet 31, so the acting rod 32 can be disposed within the positioning cylinder base 313. The acting rod 32 includes an acting slope surface 321, a fixing portion 322 and a linkage portion 323.

The acting slope surface 321 is formed along the direction from the acting rod 32 toward the positioning cylinder base 313, and the inclined angle of the acting slope surface 321 is equal to the inclined angle of the supporting sheet 31. The inclined angle is preferred to be 60° to 80°. The fixing portion 322 is formed at the most protruding position on the acting slope surface 321. The fixing portions 322 are protruding or concave corresponding to the positioning portions 315 of the supporting sheet 31. When the fixing portion 322 is a concave groove, each one of the positioning portions 315 is a protruding block. When the fixing portion 322 is a protruding block, each of the positioning portions 315 is a concave groove. As shown in the figures, the fixing portion 322 is a protruding block and each of the positioning portions 315 is a concave groove. In addition, the linkage portion 323 is formed along the direction from the acting rod 32 toward the seat back 20.

Figure 6:
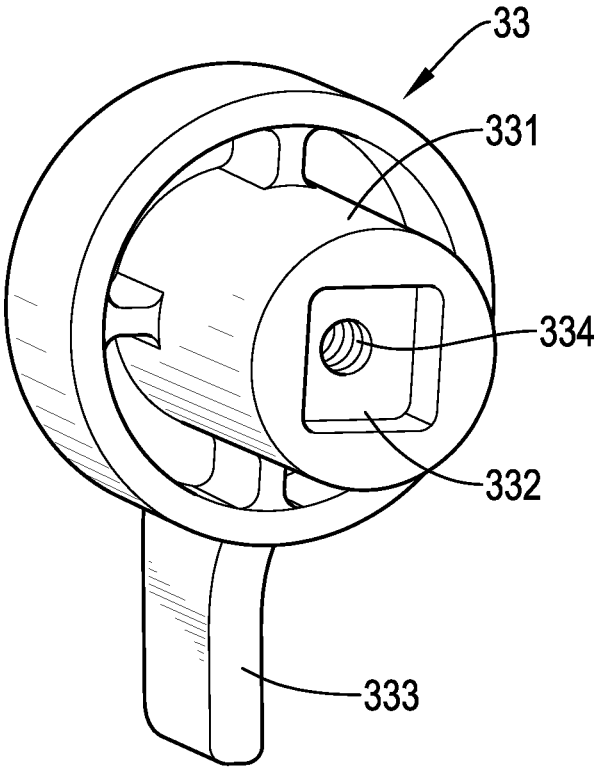
FIG. 6 is a perspective view of a knob of the adjusting assembly in the present invention.

With reference to FIG. 3 and FIG. 6, the knob 33 is disposed on a rear end of the seat back 20 and includes a protruding rod 331 and an acting portion 332.

The protruding rod 331 is formed facing to the seat back 20. The protruding rod 331 is co-acted with a passing hole 21 on the seat back 20, so the protruding rod 331 can pass through the passing hole 21 to assemble with the acting rod 32. The acting portion 332 is formed within the protruding rod 331, and the shape of the acting portion 332 is the same as the shape of the linkage portion 323 of the acting rod 32, which is a non-circular shape such as a square shape, a polygonal shape and so on. When the acting portion 332 is a bump, the linkage portion 323 can be a notch corresponding to the bump. When the acting portion 332 is a notch, the linkage portion 323 is a bump corresponding to the notch. As shown in the figures, the acting portion 332 is a notch and the linkage portion 323 is a bump. In addition, a tab 333 is formed on and extends from a peripheral edge of the knob 33 and a screw hole 334 is formed within the knob 33.

Figure 7:
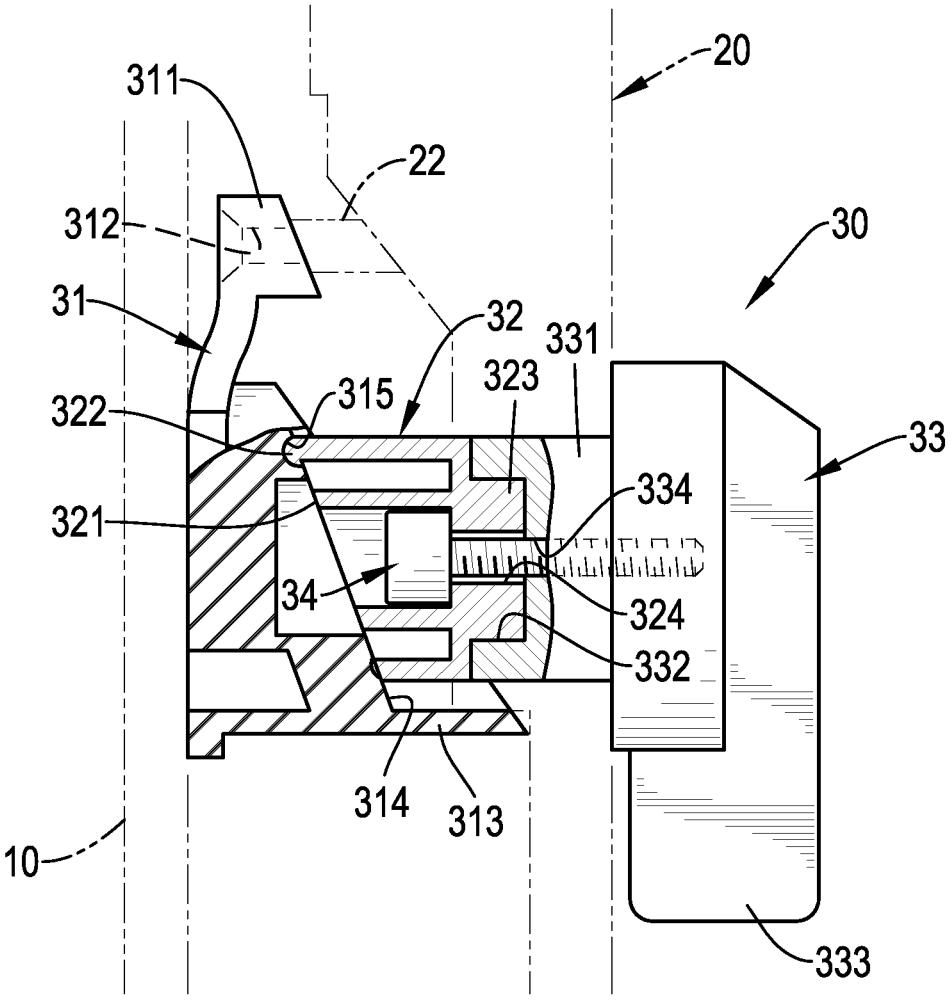
FIG. 7 is a top sectional view of the adjusting assembly disposed between the seat back and the lumbar support.

With reference to FIG. 3, when the protruding rod 331 of the knob 33 is passing through the passing hole 21 of the seat back 20, the linkage portion 323 of the acting rod 32 at a front end of the seat back 20 is correspondingly fastened to the acting portion 332. Therefore, the acting rod 32 and the knob 33 are respectively disposed at the front and the rear end of the seat back 20. With reference to FIG. 7, a locking element 34 is passing through a through-hole 324 at the centre of the acting rod 32 and is locked at the screw hole 334. Subsequently, the fastening element (not shown in figure) is passing through the through-hole 312 on the protruding portion 311 of the supporting sheet 31 and is locked at the screw hole 334 of a protruding shaft 22 of the seat back 20. Meanwhile, the acting rod 32 is disposed within the positioning cylinder base 313 and the acting slope surface 321 is close to the slope surface 314. The fixing portion 322 is fastened to one of the positioning portions 315. When the lumbar support 10 is disposed at the front end of the seat back 20, the surface of the supporting sheet 31 is disposed and attached at the rear end of the lumbar support 10.

Figure 8:
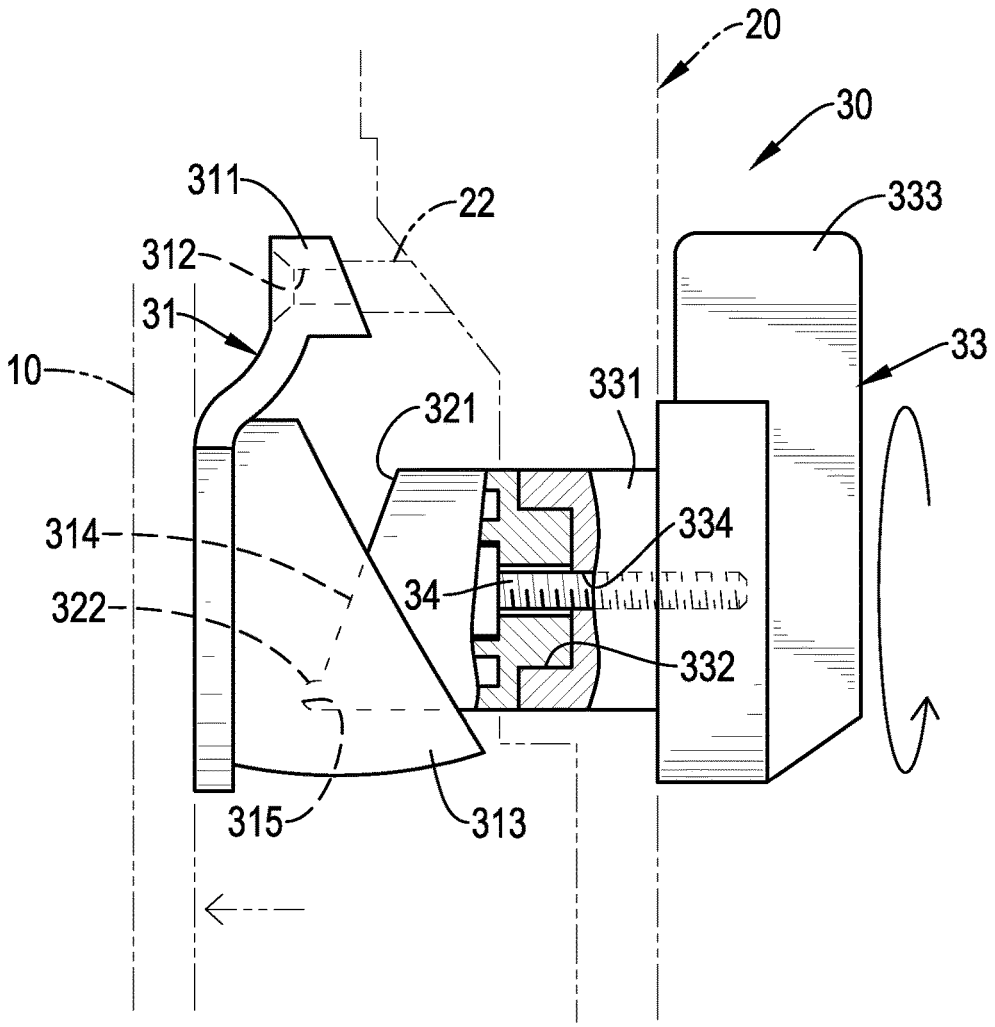
FIG. 8 is a top sectional operational view of the adjusting assembly disposed between the seat back and the lumbar support.

As shown in FIG. 7, when the acting slope surface 321 contacts the slope surface 314 face-to-face, a protruding height of the lumbar support 10 is minimized. When the lumbar support 10 will be adjusted to be more protrusive relative to the seat back 20, please refer to FIG. 8, the tab 333 is rotated to turn the knob 33. Since the knob 33 and the acting rod 32 can be co-acted by fastening the acting portion 332 and the linkage portion 323, the acting rod 32 can be rotated within the positioning cylinder base 313 at the same time. Therefore, the fixing portion 322 on the acting slope surface 321 can be fastened with a different positioning portion 315 on the slope surface 314. At this moment, the positioning portions 315 of the supporting sheet 31 are respectively located at different areas on the slope surface 314. When the acting rod 32 is rotated and the relationship between the slope surfaces is changed, the internal end of the supporting sheet 31 is moved toward the direction of the lumbar support 10 with respect to the protruding portion 311 as the fixed point so as to force the lumbar support 10 to be more protruded. Therefore, the distance between the lumbar support 10 and the seat back 20 can be changed.

Since the two sides of the seat back 20 respectively include an adjusting assembly 30, the adjusting assemblies 30 at the two sides of the seat back 20 can be adjusted to the same protruding distance or different protruding distances for different requirements. Accordingly, by the lumbar support apparatus of the present invention, the protrusive distance from the lumbar support to the seat back can be adjusted in accordance with the requirements by different people or a person with different requirements at different time, so the waist can obtain a proper supporting strength and a more reliable lumbar support structure is provided.

What is claimed is:

1. An adjustable lumbar support apparatus for a seat back, the adjustable lumbar support apparatus comprising:

a lumbar support disposed on a front end of the seat back; and two adjusting assemblies disposed between the seat back and the lumbar support, each one of the adjusting assemblies including:

a supporting sheet connected to a rear end of the lumbar support and including:

a protruding portion formed on an exterior surface of the supporting sheet and fixed on the seat back; and a positioning cylinder base formed on a rear surface of the supporting sheet, protruding toward the seat back, and including:

a rear end;

a slope surface formed on the rear end of the positioning cylinder base; and a plurality of positioning portions formed on the slope surface of the positioning cylinder base;

an acting rod disposed in the positioning cylinder base on a front of the seat back and including:

an acting slope surface formed on a front end of the acting rod and facing the positioning cylinder base;

a fixing portion formed on a most protruding part of the acting slope surface; and a linkage portion formed on a rear end of the acting rod and protruding toward the seat back; and a knob disposed on a rear end of the seat back, co-acting with the acting rod, and including:

a protruding rod formed on a front end of the knob, protruding toward the seat back, and passing through the seat back; and an acting portion formed on a front end of the protruding rod and corresponding to the linkage portion of the acting rod.

2. The adjustable lumbar support apparatus for the seat back as claimed in claim 1, wherein the acting rod and the knob are fastened to each other by a fastening element.

3. The adjustable lumbar support apparatus for the seat back as claimed in claim 2, wherein the linkage portion of the acting rod is a notch and the acting portion of the knob is a bump corresponding to the notch.

4. The adjustable lumbar support apparatus for the seat back as claimed in claim 3, wherein the notch and the bump are in square shape or polygonal shape.

5. The adjustable lumbar support apparatus for the seat back as claimed in claim 4, wherein each one of the positioning portions on the slope surface of the supporting sheet is a protruding block and the fixing portion on the acting slope surface of the acting rod is a concave groove.

6. The adjustable lumbar support apparatus for the seat back as claimed in claim 5, wherein a tab extends from a peripheral edge of the knob.

7. The adjustable lumbar support apparatus for the seat back as claimed in claim 3, wherein a tab extends from a peripheral edge of the knob.

8. The adjustable lumbar support apparatus for the seat back as claimed in claim 2, wherein the linkage portion of the acting rod is a bump and the acting portion of the knob is a notch corresponding to the bump.

9. The adjustable lumbar support apparatus for the seat back as claimed in claim 8, wherein the notch and the bump are in square shape or polygonal shape.

10. The adjustable lumbar support apparatus for the seat back as claimed in claim 9, wherein each one of the positioning portions on the slope surface of the supporting sheet is a protruding block and the fixing portion on the acting slope surface of the acting rod is a concave groove.

11. The adjustable lumbar support apparatus for the seat back as claimed in claim 8, wherein a tab extends from a peripheral edge of the knob.

12. The adjustable lumbar support apparatus for the seat back as claimed in claim 2, wherein a tab extends from a peripheral edge of the knob.

13. The adjustable lumbar support apparatus for the seat back as claimed in claim 1, wherein an angle between the slope surface of the supporting sheet and a horizontal axis is between 60° and 80°;

an angle between the acting slope surface of the acting rod and the horizontal axis is between 60° and 80°.

14. The adjustable lumbar support apparatus for the seat back as claimed in claim 13, wherein a tab extends from a peripheral edge of the knob.

15. The adjustable lumbar support apparatus for the seat back as claimed in claim 1, wherein a tab extends from a peripheral edge of the knob.

* * * * *